US005297418A

United States Patent [19]

Champaigne

[11] Patent Number: 5,297,418

[45] Date of Patent: Mar. 29, 1994

[54] GAGE FOR MEASURING THE INTENSITY OF SHOT-BLAST PEENING

[75] Inventor: Jack M. Champaigne, South Bend, Ind.

[73] Assignee: Electronics, Incorporated, Mishawaka, Ind.

[21] Appl. No.: 28,332

[22] Filed: Mar. 9, 1993

[51] Int. Cl.[5] ..... G01L 5/00

[52] U.S. Cl. ..... 73/11.02; 73/861.73; 72/53

[58] Field of Search ..... 73/11.02, 12.05, 12.09, 73/861.73; 72/53; 29/90.7; 51/320

[56] References Cited

U.S. PATENT DOCUMENTS

| | | | |
|---|---|---|---|
| 2,350,440 | 6/1944 | Almen | 73/11.02 |
| 3,000,425 | 9/1961 | Hodges et al. | 72/53 |
| 4,102,176 | 7/1978 | Fuchs | 73/11.02 |
| 4,470,292 | 9/1984 | DeClark et al. | 73/11.02 |
| 4,848,123 | 7/1989 | Thompson | 73/11.02 X |
| 5,113,680 | 5/1992 | Matsuura et al. | 73/861.73 X |

*Primary Examiner*—Richard E. Chilcot, Jr.
*Assistant Examiner*—Elizabeth L. Dougherty
*Attorney, Agent, or Firm*—James D. Hall; Thomas J. Dodd; R. Tracy Crump

[57] ABSTRACT

An Almen type gage with an improved test strip support mechanism, which concentrates the holding force at the contact points. The support mechanism includes four paired contact balls and a permanent magnet engaged between the paired balls to magnetically hold the test strip against the contact balls. Each contact ball seated atop a set screw turned into a test platform with the magnetic flux of the permanent magnets passing through both the contact balls and the set screws.

9 Claims, 3 Drawing Sheets

GAGE FOR MEASURING THE INTENSITY OF SHOT-BLAST PEENING

This invention relates to an improved gage used for measuring the intensity of shot blast peening in metal parts and more specifically to an Almen gage with a improved magnetic plate support.

BACKGROUND OF INVENTION

U.S. Pat. No. 2,350,440 to John O. Almen discloses a device used for measuring the intensity of shot blast peening on metal parts, commonly known as an Almen gage. Almen gages measure the intensity of the peening process by measuring the curvature of thin metal test strips, after one side of the test strips have been peened. The unbalanced stress in the peened surface causes the test strips to bow. The Almen gage uses two spaced knife edged supports and a measurement indicator with an reciprocating feeler to measure the curvature of the test strip. The spaced knife edged supports hold the test strip as the feeler located between the knife edges engages the test strip. Gaging the height of the arc or bend of the test strip between the two predetermined contact points along the knife edged supports provides an indication of the intensity of the peening process.

Later refinements of the Almen gage have replaced the knife edged supports with four round contact balls with the operator manually holding the test strip in place for measurement. Another version of the Almen gage added a spring loaded finger to hold the test strip in place. The spring loaded finger was difficult to operate and subject to abuse and damage. The latest revision in the Almen gage incorporated a large permanent magnet centrally mounted in the base to draw the strip against the contact balls. Generally, the magnet was spaced some distance from the test strip, which necessitated the use of a large powerful magnet. The magnetic flux of such large magnets tended to deflect the thin test strips and corrupt the measurement readings. The location of the magnet also forced the indicator stems to be constructed of non-magnetic materials in order to avoid magnetic influence, which would affect the indicator's free travel.

SUMMARY OF THE INVENTION

The gage of this invention eliminates the problems of the earlier Almen gages by incorporating a new magnetized supporting mechanism. In this invention, two separate magnets are used with each magnet extending between a pair of contact balls. The separate magnets provide a more efficient magnetic holding force, thus allowing the use of smaller magnets. The magnetic holding force is concentrated at the contact point between the strip and each pair of contact balls. With the holding force concentrated over the contact balls, no deflection in the longitudinal dimension of the test strip occurs, which improves accuracy of the readings.

Accordingly, an object of this invention is to provide for a shot peen gage with an improved support mechanism for the test strips.

Another object is to provide a shot peen gage with a magnetic support mechanism, which concentrates the holding force at the contact points.

Another object is to provide a shot peen gage with a support mechanism, which uses four paired contact balls and a permanent magnet magnetically engaged between the paired contact balls to magnetically hold the test strip to the contact balls.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art t utilize its teachings.

Figure 1:
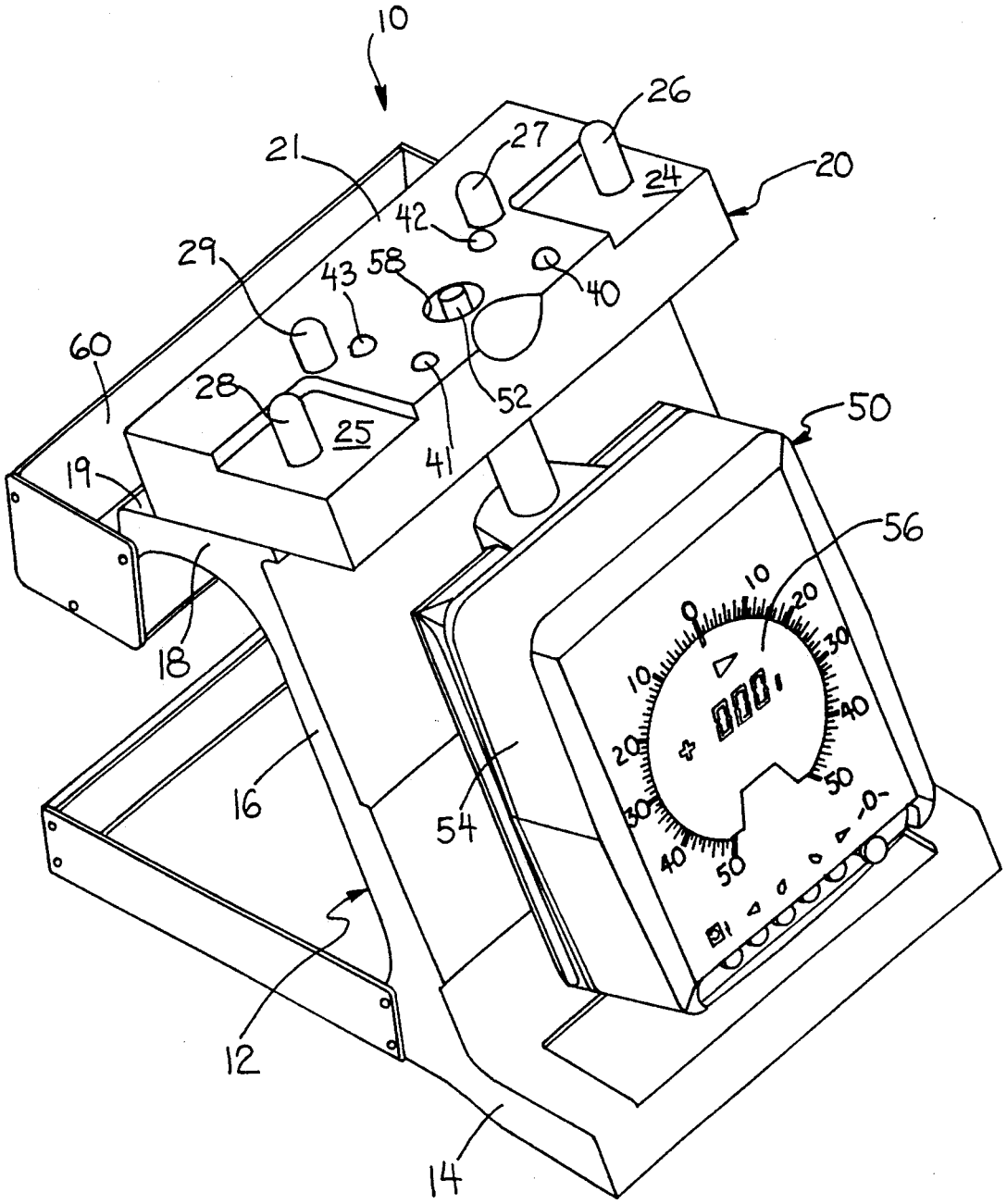
FIG. 1 is a perspective view of the gage of this invention.
Figure 2:
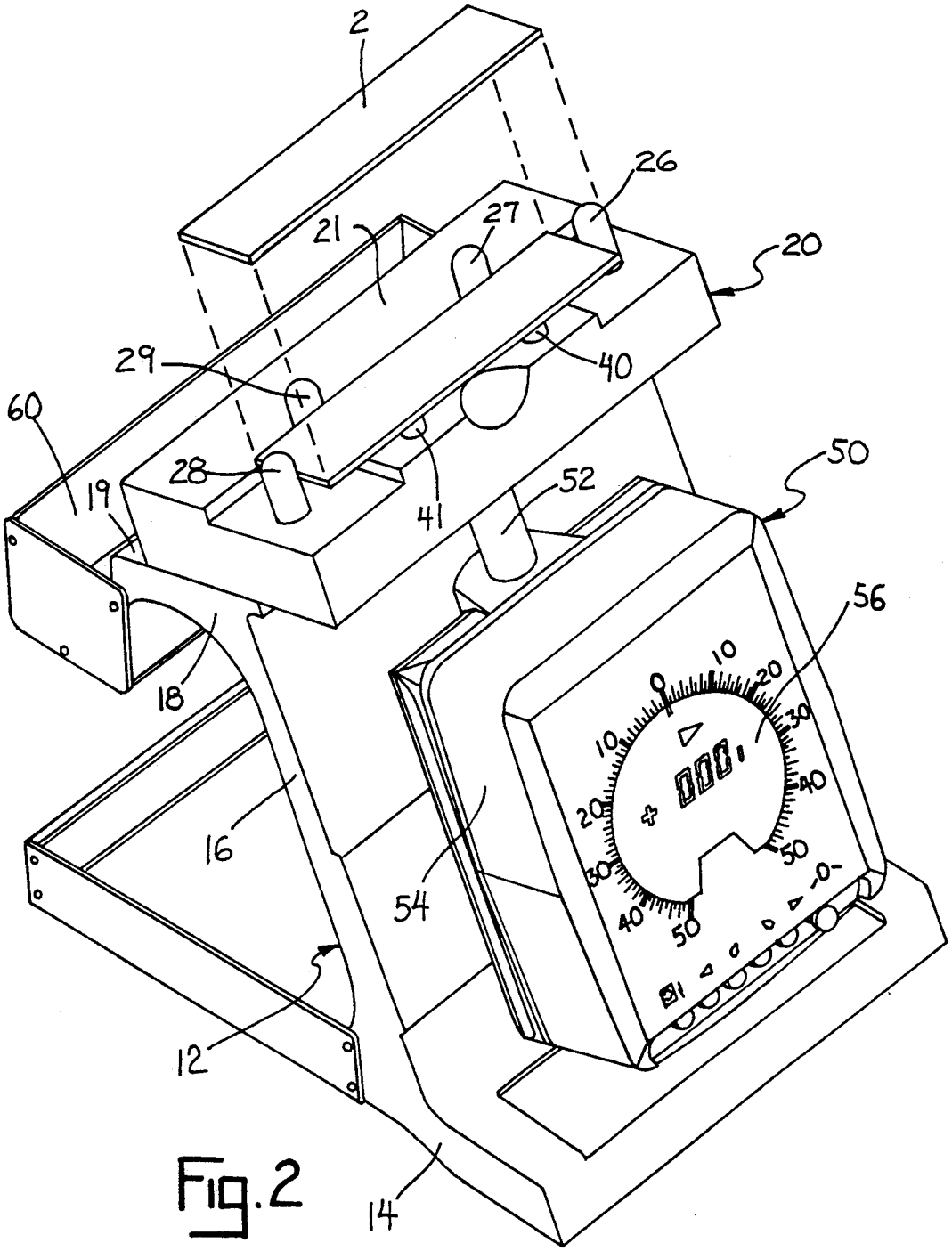
FIG. 2 is a perspective view of the gage of this invention showing a test strip seated atop the test platform.
Figure 3:
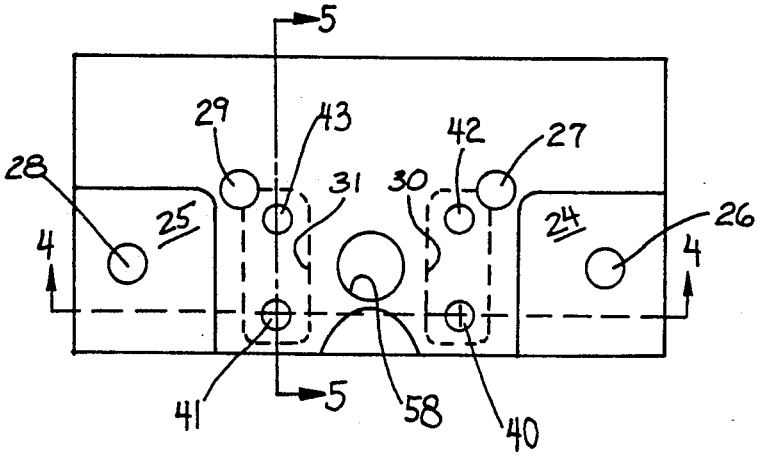
FIG. 3 is a top view of the test platform.

FIGS. 1 and 2 show the improved gage 10 of this invention. Gage 10 is used to measure the curvature of test specimen strips or Almen strips 2. Test strips 2 are thin strips of steel approximately 3 inches in length, 0.75 inches in width, and 0.05 inches in thickness.

Gage 10 includes a stand 12 with a lower support base 14 and a back partition 16 extending vertically from support platform 14. Back partition 16 terminates in an elevated shoulder 18. Generally, stand 12 is constructed from a heavy durable material, such as a cast metal, for stability. A tray 60 is mounted to the back side of shoulder 18. Test strips 2 ca be stacked within tray 60 for convenient access during testing.

A test platform 20 is securely mounted to the top face 19 of shoulder 18, by any conventional method. Test platform 20 is constructed of any suitable durable non-magnetic material. Test platform 20 projects forwardly of back partition 16 and has a top face 21 and bottom face 22. A central opening 58 is formed in platform 20. Opening 58 extends through the overhanging portion of test platform 20. As shown in FIGS. 1 and 2, top face 21 has two recessed front corners 24, 25 and four alignment posts 26, 27, 28, 29 protrude upwardly from its top face 21. Posts 26, 28 protrude from approximately the centers of corner recesses 24, 25 respectively and are used to align the ends of a test strip 2. Posts 27, 29 protrude vertically from top face 21 on longitudinal line spaced behind posts 26, 28 with respect to the front of test platform 20 and are used to align the sides of the test strip.

Figure 4:
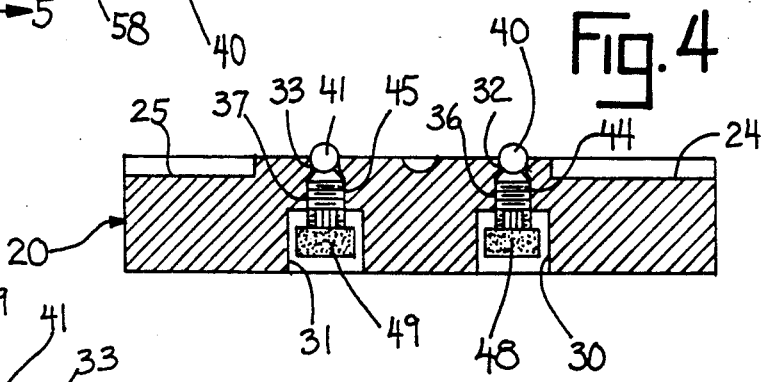
FIG. 4 is a longitudinal sectional view of the test platform taken along line 4—4 of FIG. 3.
Figure 5:
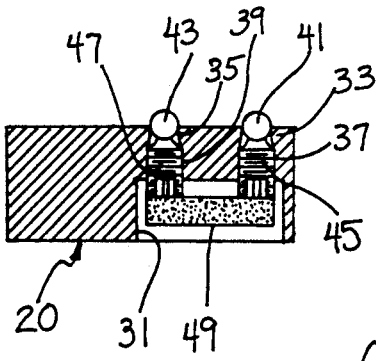
FIG. 5 is a cross sectional of the test platform taken along line 5—5 of FIG. 3.
Figure 6:
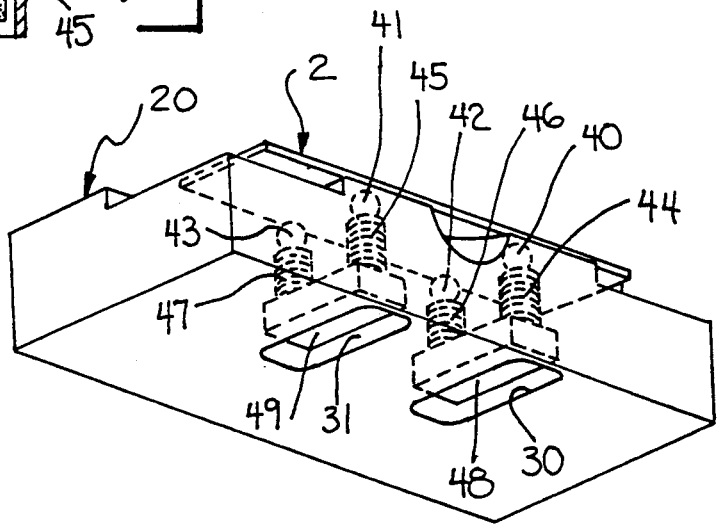
FIG. 6 is a bottom perspective view of the test platform shown separated from the gage and showing the magnet recesses.

As shown in FIGS. 4–6, platform 20 has two rectangular magnet cavities 30, 31 formed in bottom face 22 and four restrictive openings 32, 33, 34, 35 formed in top face 21. Two threaded bores 36, 38 (38 not shown in the Figures) extend between opening 32, 34 (34 not shown in the Figures) and magnet cavity 30. Another two threaded bores 37, 39 extend between opening 33, 35 and magnet cavity 31. Four set screws 44, 45, 46, 47 are turned into threaded bores 36–39 respectively. Each set screws 44–47 seats a conductive contact ball 40, 41, 42, 43 within threaded bores 32–35. The upper edge of each contact ball 40–43 extends partially above top face 21 through restricted openings 32–35. As shown in FIGS. 4–6, two permanent magnets 48, 49 extend across the base of each pair of screws 44–47 within recess 34, 35.

As shown in FIGS. 1 and 2, stand back partition 16 supports a conventional distance measuring indicator 50. Indicator 50 includes an instrument casing 54 mounted to the front side of back partition 16 underneath the overhanging portion of test platform 20. Casing 54 includes a front reading display 56. Indicator 50 can use any conventional display method whether electronic or mechanical. A reciprocating plunger or feeler 52 extends upwardly from casing 54 through opening 58 in test platform 20.

The intensity of the shot blast peening process is determined by measuring the height of the curvature of the test strips between the contact balls. Each individual test strip 2 is exposed on one side to the shot basting peening process to be measured. The unbalanced stress in the peened surface bows the test strips. As shown in FIGS. 2 and 6, test strips 2 are placed on test platform 20. Strip 2 is positioned to be located between end alignment posts 26, 28 and against side alignment posts 27, 29. In this position, strip 2 rests atop contact balls 40–43. The magnetic flux of magnets 48, 49 passes through the set screws 44–47 and balls 40–43 into the overlying strip 2 which covers the strip to be held against the balls. The magnetic flux supplies a holding force centered at the contact points between balls 40–43 and test strip 2. With strip firmly held against contact balls 40–43 by magnetic force, indicator feeler 52 can extend through platform opening 58 to engage the underside of strip 2. In this manner, indicator 20 will provide a read out on display 56 which is indicative of the curvature in the test strip 2.

It is understood that the above description does not limit the invention to the details given, but may be modified within the scope of the following claims.

I claim:

1. A gage for testing the intensity of shot blasting against an elongated conductive test strip in a peening process comprising:

a stand including a platform, two pairs of magnetically conductive balls protruding above said platform, magnetically conductive means carried by said platform for supporting each said pair of balls, magnet means for creating a magnetic attraction at each pair of balls to fixedly anchor said test strip to said pairs of balls overlying said platform, and means carried by said stand for engaging said test strip upon said balls for measuring the deflection of said test strip caused by said shot blasting.

2. The gage of claim 1 wherein said means supporting each pair of balls is a pair of magnetically conductive screws each threaded into said platform under and in contact with a said ball, each magnet extending between each pair of screws.

3. The gage of claim 2 and means protruding from said platform for aligning said test strip upon said balls.

4. The gage of claim 3 wherein said alignment means includes two opposed end posts and two adjacent side posts for receiving said test strip restrictively between said end posts and against said side posts during testing.

5. A gage for testing the intensity of shot blasting against an elongated conductive test strip in a peening process comprising:

a stand including a platform, two pairs of magnetically conductive contacts protruding above said platform, magnetically conductive means carried by said platform for supporting each said pair of contacts, magnet means for creating a magnetic attraction at each pair of contacts to fixedly anchor said test strip to said pairs of contacts overlying said platform, and means carried by said stand for engaging said test strip upon said contacts for measuring the deflection of said test strip caused by said shot blasting.

6. The gage of claim 5 wherein said magnetically conductive means supporting each pair of contacts is a pair of magnetically conductive screws each threaded into said platform under and in contact with a said pair of contacts, each magnet means extending between each pair of screws.

7. The gage of claim 6 wherein said contacts are conductive contact ball, each contact balls seated upon a conductive screw.

8. The gate of claim 5 and means protruding from said platform for aligning said test strip upon said contacts.

9. The gate of claim 8 wherein said alignment means includes two opposed end posts and two adjacent side posts for receiving said test strip restrictively between said end posts and against said side posts during testing.

* * * * *